United States Patent [19]

Greif et al.

[11] B 4,009,997

[45] Mar. 1, 1977

[54] LEVELLING AUXILIARIES FOR ACID DYES

[75] Inventors: Norbert Greif, Ludwigshafen; Michele Vescia, Limburgerhof; Manfred Daeuble, Frankenthal; Hans Heinrich, Ludwigshafen, all of Germany

[73] Assignee: BASF Aktiengesellschaft, Ludwigshafen (Rhine), Germany

[22] Filed: Aug. 15, 1974

[21] Appl. No.: 497,571

[44] Published under the second Trial Voluntary Protest Program on March 23, 1976 as document No. B 497,571.

[30] Foreign Application Priority Data

Aug. 29, 1973 Germany ..... 2343418

[52] U.S. Cl. ..... 8/169; 8/88; 8/173

[51] Int. Cl.[2] ..... D06P 1/649; D06P 5/06

[58] Field of Search ..... 8/88, 169, 173

[56] References Cited

UNITED STATES PATENTS

| | | | |
|---|---|---|---|
| 3,232,695 | 2/1966 | Robim et al. | 8/169 |
| 3,473,956 | 10/1969 | McIntyre et al. | 8/173 |
| 3,619,123 | 11/1971 | Walz et al. | 8/173 |

*Primary Examiner*—Donald E. Czaja
*Assistant Examiner*—H. H. Fletcher
*Attorney, Agent, or Firm*—Johnston, Keil, Thompson & Shurtleff

[57] ABSTRACT

A levelling auxiliary for dyeing fibrous material of polyamide fibers with acid dyes in the acid pH range in the presence of a mixture which contains (based on the solids in each case) from 30 to 90% by weight of a surfactant having sulfonic acid groups and from 10 to 70% by weight of an oxyethylated polyamide which has been prepared by the reaction of 1 part by weight of polyamide with from 2.5 to 3.5 parts by weight of ethylene oxide. Level dyeings devoid of streaks are obtained.

6 Claims, No Drawings

LEVELLING AUXILIARIES FOR ACID DYES

When polyamide filament fibers are dyed with acid dyes there are obtained as a rule different depths of color and different shades on the individual threads and this is attributable to different affinities of these threads for the dyes used, depending on the production of the individual threads. These differences are more pronounced in the case of dyes of greater fastness to wet treatment than in the case of dyes of lesser fastness to this treatment. The different coloration results however in streaks in the finished cloth or knitted goods and this constitutes a marked deterioration in the goods appeal.

It is known that a marked decrease in this streakiness can be achieved by adding an anion-active surfactant. These surfactants generally have sulfonic groups and go onto the polyamide fibers analogously to the dyes so that they may level out the differences in affinity for the dyes.

It is known from German Printed Application (DAS) No. 1,919,120 that selected surfactants containing sulfonic acid groups may be used together with cation-active polyglycol ethers containing aliphatic radicals of 10 to 18 carbon atoms for dyeing polyamide fibers with dyes which do not level well so that level dyeings devoid of streaks may be obtained in this way. It has been found however that the cation-active oxyethylation products displace the distribution equilibrium of the dye between fiber and liquor in favor of the liquor, i.e. there is a retarding effect. In special cases, particularly in the case of sulfonated alkylphenols in which the phenolic groups are combined with a glycol or glycerol molecule by way of an ether bond, as described for example in German Laid-Open Specification (DOS) No. 2,166,560 the use of large amounts of cation-active oxyethylation products may result in a deterioration in the effect against streakiness which similarly points to a retardation of the anion-active sulfonic acid by the cation-active auxiliary. Analogous effects are observed in the case of combinations of other anion-active sulfonic acids with cation-active oxyethylation products although these effects differ in degree from product to product.

One object of the invention consists in a combination of levelling agents with which the said disadvantages can be avoided and which in particular does not exhibit any retarding effect. Another object of the invention is to increase the effect of the surfactants containing sulfonic acid groups so that the desired result can be achieved with smaller amounts of the substance.

These objects are achieved with new levelling agents based on salts of surfactants containing sulfonic acid groups for the dyeing of fibrous materials which consist of or contain polyamide fibers with acid dyes in an acid pH range when the levelling agent is characterized by a content (based on the solids contained in the levelling agent) of from 30 to 90% by weight of a surfactant having sulfonic acid groups and from 10 to 70% by weight of an oxyethylated polyamide which has been obtained by the reaction of 1 part by weight of polyamide with from 2.5 to 3.5 parts by weight of ethylene oxide.

A process for the production of colloidal solutions of such oxyalkylated polyamides in water is disclosed in German Printed Application (DAS) No. 1,298,713. This literature reference shows that such oxyethylated polyamides are useful inter alia as sizing, dressing, finishing, dispersing, fiber protection and dyeing auxiliaries and also for achieving an antistatic effect. Special stress is laid in this literature reference on the improvement in the water absorptivity of synthetic fibers of polyamides and polyesters by means of the said agents. There is however nothing in the literature reference to suggest that these agents in combination with anion-active surfactants would be able to cause a marked increase in their effect, namely the decrease in streakiness in dyeing with acid dyes. Such formulations do not exhibit any retarding effect whatever and the liquor consumption is optimal and considerably better than when dyeing is carried out with the anion-active surfactant alone.

The anion-active compounds which are suitable for the levelling agent are generally those which contain sulfonic acid groups and which exhibit the necessary properties of a surfactant because of the long hydrophobic radicals contained in them. Suitable products of this kind are mainly those in which in each molecular group at least 14 to 24 carbon atoms and preferably 16 to 22 carbon atoms are connected with one another in aliphatic and/or aromatic combination. The said molecular groups may be connected with one or more than one other group by way of the hetero atoms oxygen or nitrogen and these groups may have from two to 24 carbon atoms in aliphatic and/or aromatic combination.

The compounds containing sulfonic acid groups are present in the dye liquor as alkali metal salts, e.g. sodium salts, as salts of ammonia, or as salts of organic amines such as monoethanolamine, diethanolamine or triethanolamine. Examples of such compounds containing sulfonic acid groups are alkylbenzenesulfonic acids having aliphatic side chains of from 10 to 16 carbon atoms such as nonylbenzene sulfonates, decylbenzene sulfonates or dodecylbenzene sulfonates. Glycerol ethers or phenol ethers of dodecylphenolsulfonic acid or 1-propyleneglycol ethers of dodecylphenolsulfonic acid such as are described for example in German Laid-Open Specification DOS No. 2,116,560 (which is incorporated herein by reference) are also suitable. Examples of other suitable agents are sulfonated castor oil obtained by the action of sulfuric acid, oleum or chlorosulfonic acid on castor oil. Other examples are sulfonated oleic butylamide which is obtained by the treatment of oleic butylamide with sulfuric acid or oleum, or N-sulfomethylated oleic butylamide which is obtained by condensation of oleic butylamide with formaldehyde and sodium bisulfite.

Usually from 0.1 to 3 parts and preferably from 0.25 to 1 part of oxyethylated polyamide is used for each part of compound containing sulfonic acid groups.

The oxyethylated polyamide may be prepared for example as described in German Printed Application (DAS) No. 1,298,713 (which is incorporated herein by reference) from a synthetic linear polyamide such as nylon-6 or nylon-6,6 having a molecular weight of from 5,000 to 30,000 and preferably from 10,000 to 25,000 and about 3 to 5 moles of ethylene oxide per amido group in the polyamide and it is preferably used in the form of a colloidal solution as described in this literature reference. This is achieved by dissolving in water at from 90° to 150°C the reaction product of ethylene oxide and polyamide which is usually obtained by the reaction of the polyamide at from 80° to 100°C at an ethylene oxide pressure of from 2 atmospheres gauge up to the saturation pressure.

The new levelling agent formulations are suitable for dyeing material consisting of or containing polyamide with acid dyes. Examples of dyes which can be dyed on polyamide with particularly good levelness with the new levelling agents are those described in the Examples of German Printed Application (DAS) No. 1,935,004 and German Patent Specification No. 1,244,102 (which are incorporated herein by reference). Further examples of suitable dyes are blue dye C.I. 26,360, yellow dye C.I. 18,835 and combinations of these dyes.

The following Examples illustrate the invention. The parts specified in them are by weight.

EXAMPLES

General directions:

The following dyes are used for dyeing 100 parts of PERLON porous (knitted goods of PA-6 filament threads) in 3,000 parts of water.

Combination (a)

0.1 part of a yellow dye of the formula:

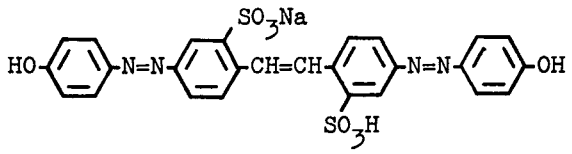

0.325 part of the orange dye of the formula:

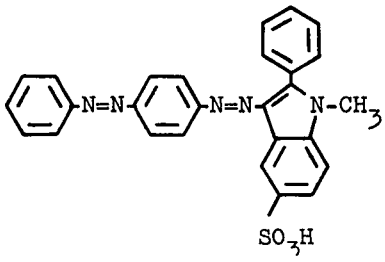

and 0.12 part of a blue dye C.I. 26,360.

Combination (b)

0.3 part of a blue dye C.I. 26,360 and 1.0 part of a yellow dye C.I. 18,835.

In each case there are added to the dye liquor 1 gram per liter of monosodium phosphate and the auxiliary indicated in the individual Examples and the dye specified above and unless otherwise stated the whole is heated in thirty minutes from 80°C to the boiling temperature and dyeing is continued for one hour at the boiling temperature.

(A) Dyeings with combination (a)

EXAMPLE 1

Auxiliaries added:

2 parts of the sodium salt of sulfomethylated oleamide;

1 part of the adduct of 3 parts of ethylene oxide to 1 part of polycaprolactam having a molecular weight of 19,000 in aqueous colloidal solution with a solids content of 40% by weight (calculated as solid).

Result:

Good levelness and hiding of streakiness.

Comparative dyeing without adding oxyethylated polyamide:

fairly unequal streaky dyeings.

EXAMPLE 2

2 parts of the sodium salt of sulfonated castor oil and 1 part of the adduct of 2.9 parts of ethylene oxide to 1 part of polycaprolactam having a molecular weight of 19,000 (in aqueous 40% colloidal solution).

Result:

Good levelness and hiding of streakiness.

Comparative dyeing without adding oxyethylated polyamide:

unequal, streaky dyeing.

EXAMPLE 3

1 part of the sodium salt of the glycerol ether of dodecylphenolsulfonic acid and 1 part of the adduct of 3.2 parts of ethylene oxide to 1 part of polyamide from adipic acid and hexamethylenediamine having a molecular weight of 16,000 (in a 40% aqueous colloidal solution).

Result:

Very good levelness and hiding of streakiness.

Comparative dyeing without adding oxyethylated polyamide:

unequal, streaky dyeing.

EXAMPLE 4

1.5 parts of diethanolamine salt of dodecylbenzenesulfonic acid and 1.0 part of the adduct of 3.5 parts of ethylene oxide to 1 part of polycaprolactam having a molecular weight of 19,000 (as an aqueous colloidal solution according to Example 1).

Result:

Very good levelness and good hiding of streakiness.

Comparative dyeing without adding oxyethylated polyamide:

very streaky, unequal dyeing.

EXAMPLE 5

1.5 parts of sulfonated oleic butylamide and 1.2 parts of the adduct of 3 parts of ethylene oxide to 1 part of polycaprolactam having a molecular weight of 19,000 (as an aqueous colloidal solution according to Example 1).

Result:

Level dyeing practically devoid of streaks.

Comparative dyeing without adding oxyethylated polyamide:

rather unequal, streaky dyeing.

EXAMPLE 6

1.0 part of the monopropylene glycol ether of the sodium salt of dodecylphenolsulfonic acid and 1.5 parts of the adduct of 3.5 parts of ethylene oxide to 1 part of polycaprolactam having a molecular weight of 19,000 (as an aqueous colloidal solution according to Example 1).

Result:

Level dyeing practically devoid of streaks.

Comparative dyeing without adding oxyethylated polyamide:

rather unequal, streaky dyeing.

Analogous results are obtained on textured nylon-6,6 fibre knitted goods when they are dyed according to Examples 1 to 6.

(B) Dyeings with dye combination (b)

EXAMPLE 7

2 parts of the sodium salt of sulfonated castor oil and 1 part of the adduct of 3.1 parts of ethylene oxide to 1 part of polycaprolactam having a molecular weight of 19,000 (as an aqueous colloidal solution having a solids content of 45%).

Result:

Level dyeing practically devoid of streaks.

Comparative dyeing without adding oxyethylated polyamide:

rather unequal, streaky dyeing.

EXAMPLE 8

1 part of the sodium salt of the glycerol ether of dodecylphenolsulfonic acid and 1 part of the adduct of 2.8 parts of ethylene oxide to 1 part of polycaprolactam having a molecular weight of 19,000 (as an aqueous colloidal solution according to Example 7).

Result:

Level dyeing practically devoid of streaks.

Comparative dyeing without adding oxyethylated polyamide:

rather unequal and streaky dyeing.

EXAMPLE 9

1 part of the diethanolamine salt of dodecylbenzenesulfonic acid and 1 part of the adduct of 3 parts of ethylene oxide to 1 part of polycaprolactam having a molecular weight of 19,000 (as an aqueous colloidal solution according to Example 7).

Result:

Level dyeing practically devoid of streaks.

Comparative dyeing without adding oxyethylated polyamide:

very streaky, unequal dyeing.

EXAMPLE 10

1 part of the sodium salt of sulfonated oleic butylamide and 1 part of the adduct of 3 parts of ethylene oxide to 1 part of polycaprolactam having a molecular weight of 19,000 (as an aqueous colloidal solution according to Example 1).

Dyeing is carried out for 90 minutes at 115°C.

Result:

A level dyeing devoid of streaks.

When the oxyethylated polycaprolactam is not added a dyeing is obtained which is clearly inferior.

We claim:

1. In a process for dyeing a fibrous material consisting essentially of polyamide fibers with an acid dye in an acid pH range, the inprovement which comprises: carrying out the dyeing in the presence of a levelling auxiliary mixture which, based on the solids in each case, contains:

a. from 30 to 90% by weight of a surfactant containing one or more sulfonic acid groups in salt form; and b. from 10 to 70% by weight of an oxyethylated synthetic linear polyamide which has been prepared by the reaction of 1 part by weight of polyamide with from 2.5 to 3.5 parts by weight of ethylene oxide.

2. A process as claimed in claim 1 wherein an alkali metal, ammonium or amine salt of a sulfonated castor oil, alkylbenzenesulfonic acid, a glycol ether, propylene glycol ether or glycerol ether of an alkylphenolsulfonic acid, an alkylnaphthalenesulfonic acid or sulfonated oleic butylamide is used as the surfactant.

3. A process as claimed in claim 1 wherein the oxyethylated polyamide has a molecular weight of from 5,000 to 30,000 and contains from 3 to 5 moles of ethylene oxide per amido group.

4. A process as claimed in claim 2 wherein the oxyethylated polyamide has a molecular weight from 5,000 to 30,000 and contains from 3 to 5 mols of ethylene oxide per amido group.

5. Fibrous materials consisting essentially of polyamide fibers which have been dyed by a process as claimed in claim 1.

6. A levelling auxiliary for use in dyeing a fibrous material consisting essentially of polyamide fibers with an acid dye in an acid pH range which comprises a mixture, based on the solids contained in the levelling agent, of:

a. from 30 to 90% by weight of a surfactant containing one or more sulfonic acid groups; and b. from 10 to 70% by weight of an oxyethylated synthetic linear polyamide which has been obtained by the reaction of 1 part by weight of polyamide with from 2.5 to 3.5 parts by weight of ethylene oxide.

* * * * *